US005181935A

United States Patent [19]

Reinert et al.

[11] Patent Number: 5,181,935

[45] Date of Patent: Jan. 26, 1993

[54] THERMAL AND PHOTOCHEMICAL STABILIZATION OF DYEINGS ON POLYAMIDE FIBERS:STERICALLY HINDERED PHENOL AND ULTRA-VIOLET ABSORBER

[75] Inventors: Gerhard Reinert, Allschwil; Francesco Fuso, Münchenstein, both of Switzerland

[73] Assignee: Ciba-Geigy Corporation, Ardsley, N.Y.

[21] Appl. No.: 705,429

[22] Filed: May 24, 1991

[30] Foreign Application Priority Data

May 31, 1990 [CH] Switzerland ..... 1843/90

[51] Int. Cl.[5] ..... D06P 5/02; D06M 13/43

[52] U.S. Cl. ..... 8/442; 8/490; 8/566; 8/573; 8/588; 8/607; 8/613; 8/924

[58] Field of Search ..... 8/442, 490

[56] References Cited

U.S. PATENT DOCUMENTS

| | | | |
|---|---|---|---|
| 3,259,627 | 7/1966 | Duennenberger et al. | 8/115.6 |
| 3,665,031 | 5/1972 | Peterli et al. | 562/44 |
| 4,831,068 | 5/1989 | Reinert et al. | 8/442 |
| 4,874,391 | 10/1989 | Reinert | 8/442 |
| 5,030,243 | 7/1991 | Reinert | 8/490 |
| 5,057,562 | 10/1991 | Reinert | 8/442 |
| 5,069,681 | 12/1991 | Bouwknegt et al. | 8/442 |
| 5,074,885 | 12/1991 | Reinert | 8/442 |
| 5,096,456 | 3/1992 | Reinert et al. | 8/442 |

FOREIGN PATENT DOCUMENTS 13164 5/1969 Switzerland .

*Primary Examiner*—A. Lionel Clingman

*Attorney, Agent, or Firm*—Marla J. Mathias; Edward McC. Roberts

[57] ABSTRACT

Processes for improving the thermal and/or photochemical stability of undyed and dyed polyamide fibers by treatment with an agent from an aqueous bath containing (A) a compound of the formula (I) defined in claim 1 and (B) a UV absorber.

16 Claims, No Drawings

THERMAL AND PHOTOCHEMICAL STABILIZATION OF DYEINGS ON POLYAMIDE FIBERS:STERICALLY HINDERED PHENOL AND ULTRA-VIOLET ABSORBER

The present invention relates to a process for improving the thermal and/or photochemical stability of undyed and dyed polyamide fibres and to the polyamide fibre material treated therewith.

The protection of undyed polymers, for example polyamides, against the effect of heat and/or oxygen (air oxidation) by means of water-soluble phenolic antioxidants is known from U.S. Pat. No. 3,665,031. However, this protection does not satisfy today's requirements.

It has now been found that undyed and dyed polyamide fibres can be better protected by treatment with phenolic water-soluble antioxidants and UV absorbers.

Accordingly, the invention relates to a process for improving the thermal and/or photochemical stability of undyed and dyed polyamide fibers, which comprises treating the fibres with an agent from an aqueous beth containing (A) a water-soluble compound of the formula (1)

$$(A\text{-}Y\text{-})_n Z(\text{-}W)_m \quad (1)$$

in which A is the radical of a sterically hindered phenol from the benzene series, Y is a radical of the formula (2) or (3)

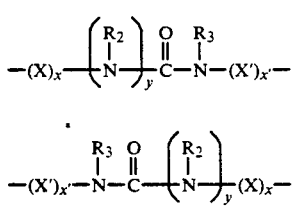

(2)

(3)

in which X and X', independently of one another, are alkylene, oxaalkylene or thiaalkylene, $R_2$ and $R_3$, independently of one another, are hydrogen or a substituted or unsubstituted alkyl group and x, x' and y, independently of one another, are each 0 or 1, Z is an aliphatic or a carbocyclic aromatic radical, the latter containing at most two mono- or bicyclic rings, W is a sulfo group and m and n, independently of one another, are 1 or 2, and their water-soluble salts, and (B) a UV absorber.

A in formula (1) is, for example, a monohydroxyphenyl radical in which at least one ortho position with respect to the hydroxyl group is substituted by an alkyl, cycloalkyl or aralkyl group and which, if desired, contains further substituents.

Alkyl groups in the ortho position with respect to the hydroxyl group of A can be linear or branched and contain 1-12, preferably 4-8, C atoms. Of these, α-branched alkyl groups are preferred. They are, for example, a methyl, ethyl, isopropyl, tert-butyl, isoamyl, octyl, tert-octyl or dodecyl group. Of these, the tert-butyl group is particularly preferred.

Cycloalkyl groups in the ortho position with respect to the hydroxyl group A contain 6-10, preferably 6-8, C atoms. Examples of these are the cyclohexyl, methylcyclohexyl and cyclooctyl group.

Aralkyl groups in the ortho position with respect to the hydroxyl group of A contain 7-10, preferably 8-9, C atoms. Examples of these are the α-methyl and α,α-dimethylbenzyl group.

In addition, the radical A can be substituted by further alkyl, cycloalkyl or aralkyl groups defined above, which are preferably in the o'- or p-position with respect to the hydroxyl group, provided these positions are not occupied by the bonding to Y. Furthermore, at least one meta position with respect to the hydroxyl group is advantageously unsubstituted, while the other can be substituted by lower alkyl groups, such as the methyl group.

Due to their easy accessibility and their favourable stabilising effect, compounds of the formula (1) in which A is a radical of the formula (4)

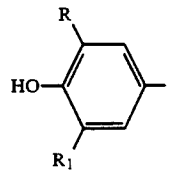

(4)

in which R and $R_1$, independently of one another, are hydrogen, methyl or tert-butyl and the sum of the carbon atoms of R and $R_1$ is at least 2 are particularly preferred.

X and X' in formulae (2) and (3) can be straight-chain or branched and contain 1 to 8, preferably 1 to 5, C atoms. Examples of these are the methylene, ethylene, trimethylene, propylene, 2-thiatrimethylene or 2-oxapentamethylene radical.

Particular preference is given to compounds in which two hetero atoms in radicals X and X' are not bound to the same saturated, i.e. tetrahedral, carbon atom.

Alkyl groups $R_2$ or $R_3$ in formulae (2) and (3) can be straight-chain or branched and contain 1 to 18, preferably 1 to 8, C atoms. Examples of these are the methyl, ethyl, isopropyl, pentyl, octyl, dodecyl and octadecyl group.

Examples of substituted alkyl groups $R_2$ or $R_3$ are hydroxyalkyl, alkoxyalkyl aminoalkyl, alkylaminoalkyl or dialkylaminoalkyl groups having a total of 2 to 10, preferably 2 to 5, C atoms. Examples of these are the β-hydroxyethyl, β-methoxyethyl, β-aminoethyl, β,β'-diethylaminoethyl or the β-butylaminoethyl group.

$R_2$ or $R_3$ can also be aryl group, preferably a phenyl group.

Compounds in which y in formulae (2) and (3) is zero in general have a substantially better stabilising effect than those compounds in which y is one.

Particular preference is given to compounds of the formula (1) in which Y is a radical of the formula (5)

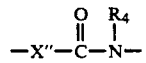

(5)

in which $R_4$ is hydrogen or $C_1$-$C_4$alkyl and X'' is $C_1$-$C_4$alkylene.

Z in formula (1) is, for example, the radical of a lower alkane which is unsubstituted or substituted by carboxy groups and has at least two C atoms, the radical of a benzene ring which is unsubstituted or substituted by chlorine or bromine, $C_1$-$C_4$alkyl, $C_1$-$C_4$alkoxy, $C_1$-$C_4$alkoxycarbonylamino, hydroxyl, carboxy, phenylethyl, styryl, phenyl, phenoxy, phenylthio, phenylsulfonyl or acylamino, in which the group W can be bound directly to this benzene ring or to a monocyclic aryl radical of one of its substituents, or it is a naphthalene or tetraline radical.

As a radical of a lower alkane, Z can be straight-chain or branched and contain 2 to 5, preferably 2, C atoms. Thus, it is, for example, an ethylene, propylene, trimethylene or pentamethylene radical. This radical can, if desired, be additionally substituted by carboxyl groups. An example of this is the carboxyethylene radical.

As benzene radical, Z in formula (1) can be further substituted. For example, it can have straight-chain or branched $C_1$–$C_4$alkyl radicals, for example it can be substituted by a methyl, ethyl or isopropyl group; of these, the methyl group is preferred. Examples of $C_1$–$C_4$alkoxy groups as substituents of a benzene radical Z are the methoxy, ethoxy or butoxy group. The acyl radical of Z as a benzene radically substituted by an acylamino group is derived in particular from a $C_2$–$C_6$aliphatic or a monocarboxylic aromatic carboxylic acid. Examples are the radical of acetic, propionic, β-methoxypropionic, benzoic, aminobenzoic or methylbenzoic acid. Examples of $C_1$–$C_4$alkoxycarbonylamino groups as substituents of a benzene radical Z are the methoxy, ethoxy or butoxycarbonylamino radical.

Phenylethyl, styryl, phenyl, phenoxy, phenylthio or phenylsulfonyl groups as substituents of group Z can be unsubstituted or substituted by chlorine or bromine, $C_1$–$C_4$alkyl groups, such as the methyl or ethyl group, $C_1$–$C_4$alkoxy groups, such as the methoxy group, acylamino groups, such as the acetyl- or benzoylamino group or alkoxycarbonylamino groups, such as the methoxy- or ethoxycarbonylamino group.

If desired, two or more identical or different of the abovementioned substituents of the benzene radical Z or its aryl-containing substituents can be present simultaneously.

As naphthalene radical, the group Z can be unsubstituted or substituted by $C_1$–$C_4$alkyl or alkoxy groups, such as the methyl or methoxy group.

Compounds of the formula (1) in which the radical Z contains hydroxyl, amino, acylamino, alkoxycarbonylamino or styryl substituents in general show more discoloration upon exposure than compounds in which Z is free of substituents or is substituted in a different manner.

For economical reasons, compounds in which Z is an ethylene radical, a phenylene, toluylene, chlorophenylene or naphthylene radical or a divalent radical of diphenyl ether, methyl- or chlorodiphenyl ether, or in certain applications compounds in which Z is a trivalent radical of benzene or naphthalene are particularly preferred. Of these, compounds in which Z is a phenyl or diphenyl ether radical show particularly good light fastness, while compounds in which Z is a naphthyl or phenylethylphenyl radical have excellent wash fastness properties.

The sulfo group W in formula (1) is free, but can also preferably be present in the form of its alkali metal salts, alkaline earth metal salts, ammonium salt or salt of organic nitrogen bases. Owing to the low solubility of certain calcium salts, strontium salts and barium salts in water-containing media and for economical reasons, compounds of the formula (1) in which the group W is present in the form of its lithium salt, sodium salt, potassium salt, magnesium salt or ammonium salt or as an ammonium salt of an organic nitrogen base, the cation of which has the formula (6)

$$\overset{+}{N}R'R''R'''R'''' \qquad (6)$$

in which R', R'', R''', R'''', independently of one another, are hydrogen, $C_1$–$C_4$alkyl or β-hydroxy-$C_1$–$C_4$alkyl or cyclohexyl, in which at least two of these radicals can form a carbo- or heterocyclic ring system with one another, are preferred.

Examples of organic nitrogen bases which can form ammonium salts of this type with the group W are trimethylamine, trieethylamine, triethanolamine, diethanolamine, ethanolamine, cyclohexylamine, dicyclohexylamine, hexamethyleneimine or morpholine.

Compounds of the formula (7)

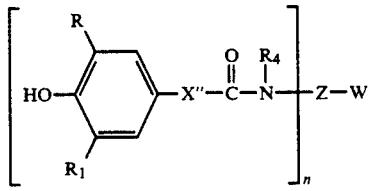

(7)

have a particularly favourable stabilising effect.

In this formula, R and $R_1$, independently of one another, are methyl or tert-butyl, $R_4$ is hydrogen or $C_1$–$C_4$alkyl, X'' is $C_1$–$C_4$alkylene, Z is an ethylene radical, a di- or trivalent radical of benzene or naphthalene or a divalent radical of diphenyl ether, W is a sulfo group and n is 1 or 2.

Group W can be present in these compounds free or also in the form of its salts defined above.

Of the compounds of the formula (7), those where R=$R_1$=methyl are economically particularly favourable, while those where R=methyl and $R_1$=tert-butyl and in particular those where R=$R_1$=tert-butyl have excellent resistance to alkali.

Components (B) which may be mentioned are all UV absorbers which are described, for example, in U.S. Pat. Nos. 2,777,828; 2,853,521; 3,259,627; 3,293,247; 3,382,183; 3,403,183; 3,423,360; 4,127,586; 4,230,867; 4,511,596 and 4,698,064.

However, UV absorbers which have been made water-soluble are preferably suitable. Those are described, for example, in U.S. Pat. Nos. 4,141,903, 4,230,867, 4,698,064 and 4,770,667.

For example, the following compounds can be used:

a) 2-hydroxybenzophenones of the formula (8)

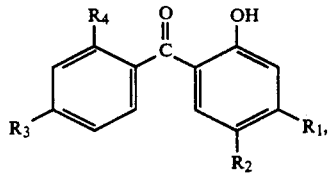

(8)

in which $R_1$ is hydrogen, hydroxyl, $C_1$–$C_{14}$alkoxy or phenoxy, $R_2$ is hydrogen, halogen, $C_1$–$C_4$alkyl or sulfo, $R_3$ is hydrogen, hydroxyl or $C_1$–$C_4$alkoxy and $R_4$ is hydrogen, hydroxyl or carboxy, b) 2-(2'-hydroxyphenyl)benzotriazoles of the formula (9)

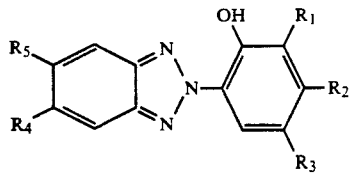

(9)

in which $R_1$ is hydrogen, chlorine, sulfo, $C_1$–$C_{12}$alkyl, $C_5$–$C_6$cycloalkyl, ($C_1$–$C_8$alkyl)phenyl, $C_7$–$C_9$phenylalkyl or sulfonated $C_7$–$C_9$phenylalkyl, $R_2$ is hydrogen, chlorine, $C_1$–$C_4$alkyl, $C_1$–$C_4$alkoxy, hydroxyl or sulfo, $R_3$ is $C_1$–$C_{12}$alkyl, chlorine, sulfo, $C_1$–$C_4$alkoxy, phenyl, ($C_1$–$C_8$alkyl)phenyl, $C_5$–$C_6$cycloalkyl, $C_2$–$C_9$alkoxycarbonyl, carboxyethyl, $C_7$–$C_9$phenylalkyl or sulfonated $C_7$–$C_9$phenylalkyl, $R_4$ is hydrogen, chlorine, $C_1$–$C_4$alkyl, $C_1$–$C_4$alkoxy, $C_2$–$C_9$alkoxycarbonyl, carboxy or sulfo and $R_5$ is hydrogen or chlorine, c) 2-(2'-hydroxyphenyl)-s-triazines of the formula (10)

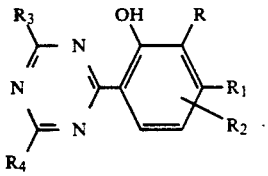

(10)

in which R is hydrogen, halogen, $C_1$–$C_4$alkyl or sulfo, $R_1$ is hydrogen, $C_1$–$C_4$alkyl, $C_1$–$C_4$alkoxy or hydroxyl, $R_2$ is hydrogen or sulfo and $R_3$ and $R_4$, independently of one another, are $C_1$–$C_4$alkyl, $C_1$–$C_4$alkoxy, $C_5$–$C_6$cycloalkyl, phenyl or phenyl substituted by $C_1$–$C_4$alkyl and/or hydroxyl, and d) s-triazine compounds of the formula (11)

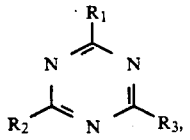

(11)

in which at least one of the substituents $R_1$, $R_2$ and $R_3$ is a radical of the formula

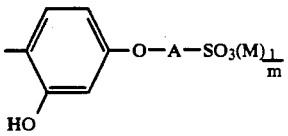

(12)

in which A is $C_3$–$C_4$alkylene or 2-hydroxytrimethylene and M is sodium, potassium, calcium, magnesium, ammonium or tetra-$C_1$–$C_4$alkylammonium and m is 1 or 2, and the remaining substituent or the remaining substituents are, independently of one another, $C_1$–$C_{12}$alkyl, phenyl, $C_1$–$C_{12}$alkyl which is bound to the triazinyl radical via oxygen, sulfur, imino or $C_1$–$C_{11}$alkylimino, or are phenyl or a radical of the formula (12), for example the potassium salt of the compound of the formula (11), in which $R_1$ is phenyl and $R_2$ and $R_3$ are each the radical of the formula (12) or the sodium salt of the compound of the formula (11), in which $R_1$ is p-chlorophenyl and $R_2$ and $R_3$ are each the radical of the formula (12).

In formulae (8) to (12), $C_1$–$C_4$alkyl is, for example, methyl, ethyl, propyl, isopropyl, n-butyl, sec-butyl or tert-butyl; $C_1$–$C_4$alkoxy is, for example, methoxy, ethoxy, propoxy or n-butoxy; $C_1$–$C_{14}$alkoxy is, for example, methoxy, ethoxy, propoxy, n-butoxy, octyloxy, dodecyloxy or tetradecyloxy; $C_1$–$C_{12}$alkyl is, for example, ethyl, amyl, tert-octyl, n-dodecyl and preferably methyl, sec-butyl or tert-butyl; $C_2$–$C_9$alkoxycarbonyl is, for example, ethoxycarbonyl, n-octoxycarbonyl or preferably methoxycarbonyl; $C_5$-$C_6$cycloalkyl is for example, cyclopentyl or cyclohexyl; ($C_1$-$C_8$alkyl)phenyl is, for example, methylphenyl, tert-butylphenyl, tert-amylphenyl or tert-octylphenyl; $C_7$–$C_9$phenylalkyl is, for example, benzyl, α-methylbenzyl or preferably α,α-dimethylbenzyl, and $C_1$–$C_{11}$alkylimino is, for example, methyl-, ethyl-, butyl-, hexyl-, octyl-, decyl- or undecylimino.

The carboxy and sulfo groups can be present in the free form or salt form, for example as alkali metal salts, alkaline earth metal salts, ammonium or amine salts.

The water-soluble compounds of the formula (1) are known, for example from U.S. Pat. No. 3,665,031 and can be prepared by methods known per se, for example by reacting n mol of a compound of the formula (13)

$$A\text{-}(X)_x\text{-}P \qquad (13)$$

with one mol of a compound of the formula (14)

$$[W\text{-}_m Z\text{-}(X')_{x'}\text{-}Q]_n, \qquad (14)$$

in which formulae one of P and Q is the group -NH-$R_3$, the other is the group

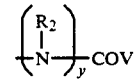

V, in the case where y is 1, is the group -OAr, in the case where y is ), a chlorine or bromine atom or a reactive amino group, in which Ar is an aromatic radical of the benzene or naphthalene series with elimination of HV.

Examples of starting materials of the formula (15)

$$A\text{-}(X)_x\text{-}NH\text{-}R_3 \qquad (15)$$

in which A, X, x and $R_3$ are as defined above, which fall under the formula (13) and are suitable for preparing the water-soluble compounds according to the invention are: 4-hydroxy-3,5-di-tert-butylaniline, 4-hydroxy-3,5-di-tert-butyl-5-methylaniline, 4-hydroxy-3,5-dicyclohexylaniline, 4-hydroxy-3,5-di-tert-amylaniline, 4-hydroxy-3,5-di-cyclohexylbenzylamine, 4-hydroxy-3-methylcyclohexyl-5-methylaniline, 2-hydroxy-3-α,α-dimethylbenzyl-5-methylbenzylamine, 4-hydroxy-3,5-dibenzylaniline, γ-(4-hydroxy-3,5-dibenzylphenyl)-propylamine, 2-hydroxy-3-tert-butyl-5-dodecylaniline, 4-hydroxy-3-tert-octyl-5-methylbenzylamine, 4-hydroxy-3,5-diisopropylbenzylamine, 4-hydroxy-3-tert-butyl-6methylbenzylamine, 4-hydroxy-3,5-di-tert-amylbenzylamine, 2-hydroxy-3,5-dimethylaniline and 2-hydroxy-3-tert-butyl-5-methylbenzylamine.

Examples of starting materials of the formula (16)

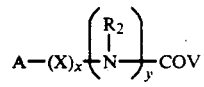

(16)

in which A, X, x, $R_2$, y and V are as defined above and which fall under the formula (13) are:

β-(4-hydroxy-3,5-di-tert-butylphenyl)-propionyl chloride, 4-hydroxy-3,5-di-tert-butylphenylacetyl chloride, 4-hydroxy-3,5-di-tert-butyl benzoyl chloride, 4-hydroxy-3-tert-butyl-5-methylphenylacetyl chloride, 2-hydroxy-3,5-dimethylbenzoyl chloride, 2-hydroxy-3-tert-butyl-5-methylbenzoyl chloride, S-(4-hydroxy-3-tert-butyl-5-methylbenzyl)thioglycolyl chloride, 4-hydroxy-5-tert-butylphenylacetyl chloride, β-(4-hydroxy-3,5-dicyclohexylphenyl)propionyl bromide, (4-hydroxy-3,5-dicyclohexylphenyl)acetyl chloride, β-(4-hydroxy-3-benzyl-5-methylphenyl)propionyl chloride, (4-hydroxy-3-benzyl-5-methylphenyl)acetyl chloride, 4-hydroxy-3,5-di-iospropylphenylacetyl chloride, S-(4-hydroxy-3,5-diisopropylbenzyl)thioglycolyl chloride, β-[ω-(4-hydroxy-3,5-di-tert-butylphenyl)-propyloxy]propionyl chloride, [ω-(4-hydroxy-3,5-di-tert-butylphenyl)propyloxy]acetyl chloride, β-methyl-β-(4-hydroxy-3,5-di-tert-butylphenyl)propionyl chloride, 4-hydroxy-3,5-di-tert-amylbenzyloxyacetyl chloride, and 4-hydroxy-5-tert-butyl-3-ethylbenzyloxyacetyl chloride.

Examples of starting materials of the formula (17)

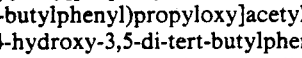

(17)

in which W, m, Z, X', x', $R_3$ and n are as defined above and which fall under the formula (14), are:

2-aminobenzenesulfonic acid, 3-aminobenzenesulfonic acid, 4-aminobenzenesulfonic acid, 5-chlor-2-aminobenzenesulfonic acid, 5-methyl-4-chloro-2-aminobenzenesulfonic acid, 2-chloro-5-aminobenzenesulfonic acid, 4-chloro-3-aminobenzenesulfonic acid, 5-chlor-3-methyl-3-aminobenzenesulfonic acid, 2,5-dichloro-4-aminobenzenesulfonic acid, 3-bromo-6-aminobenzenesulfonic acid, 3,4-dichloro-6-aminobenzenesulfonic acid, 1aminotetraline-4-sulfonic acid, 1-aminobenzene-2,5-disulfonic acid, 1-aminobenzene-2,4-disulfonic acid, 1,3-diaminobenzene-4-sulfonic acid, 1,4-aminobenzene-2-sulfonic acid, 2-amino-5-methylbenzenesulfonic acid, 5-amino-2,4-dimethylbenzenesulfonic acid, 4-amino-2-methylbenzenesulfonic acid, 3-amino-5-isopropyl-2-methylbenzenesulfonic acid, 2-amino-4,5-dimethylbenzenesulfonic acid, 2-amino-4,5-dimethyoxybenzenesulfonic acid, 5-amino-2-methylbenzenesulfonic acid, 2-amino-5-ethylbenzenesulfonic acid, 1-aminonaphthalene-3-sulfonic acid, 1-aminonaphthalene-4sulfonic acid, 1-aminonaphthalene-5-sulfonic acid, 1-aminonaphthalene-6-sulfonic acid, 1-aminonaphthalene-7-sulfonic acid, 1-aminonaphthalene-8-sulfonic acid, 2-aminonaphthalene-1-sulfonic acid, 2-amino-naphthalene-5-sulfonic acid, 2-aminonaphthalene-6-sulfonic acid, 1-aminonaphthalene-3,6-disulfonic acid, 1-aminonaphthalene-3,8-disulfonic acid, 2-aminonaphthalene-4,8-disulfonic acid, 1,4-diaminonaphthalene-6-sulfonic acid, 3-amino-4-methoxybenzenesulfonic acid, 1-amino-2-methoxynaphthalene-6-sulfonic acid, 3-amino-4-hydroxybenzenesulfonic acid, 3-amino-6-hydroxybenzene-1,5-disulfonic acid, 2-amino-5-hydroxynaphthalene-7-sulfonic acid, 2-acetamido-5-aminobenzenesulfonic acid, 2-amino-5-(p-aminobenzoylamino)benzenesulfonic acid, 2-aminonaphthalene-5,7-disulfonic acid, 2-aminonaphthalene-6,8-disulfonic acid, 2-amino-5-benzamidobenzenesulfonic acid, 4,4'-diamino-2,2'-disulfodiphenyl thioether, 2-amino-4-carboxy-5-chlorobenzenesulfonic acid, 4-amino-3-carboxybenzenesulfonic acid,5amino-3-sulfosalicylic acid, 2-(β-phenylethyl)-5-amino-benzenesulfonic acid, 1,2-bis[4-amino-2-sulfophenyl]ethane, 4,4'-diaminostilbene-2,2'-disulfonic acid, 4-aminostilbene-2-sulfonic acid, 4,4'-diamino-2'-methoxystilbene-2-sulfonic acid, 4-amino-3-sulfodiphenyl ether, 2-amino-4-sulfodiphenyl ether, 2-amino-2'-methyl-4-sulfodiphenyl ether, 2-amino-4-chloro-4'-amyl-5-sulfodiphenyl ether, 2-amino-4,4'-dichloro-2'-sulfodiphenyl ether, 2-amino-4'-methyl-4-sulfodiphenyl sulfone, 2,5-diamino-2'-methyl-4-sulfodiphenyl ether, benzidine-2,2'-disulfonic acid, 3,3'-dimethylbenzidine-6-sulfonic acid, benzidine-2-sulfonic acid, 2'-amino-3-sulfodiphenyl sulfone, 5'-amino-2'-methyl-3-sulfodiphenyl sulfone, 2',5'-diamino-4-methyl-3-sulfodiphenyl sulfone, 3'-amino-4'-hydroxy-3-sulfodiphenyl sulfone, 3,3'-diamino-4,4'-disulfodiphenyl sulfone, N-ethyanilin-4-sulfonic acid, N-methyl-2-naphthylamine-7-sulfonic acid, 2-aminoethanesulfonic acid, N-methyl-, -ethyl-, -propyl-, -isopropyl-, -amyl-, -hexyl-, -cyclohexyl-, -octyl-, -phenyl-, -dodecyl- or -stearyl-2-aminoethanesulfonic acid, 2-methyl-2-aminoethanesulfonic acid, ω-aminopropanesulfonic acid, ω-aminobutanesulfonic acid, ω-aminopentanesulfonic acid, N-methyl-γ-aminopropanesulfonic acid, 1,2-diaminoethanesulfonic acid, 2-methylaminopropanesulfonic acid and 2-amino-2-carboxyethanesulfonic acid.

Examples of starting materials of the formula (18)

(18)

in which W, m, Z, X', x', $R_2$, y, V and n are as defined above and which fall under the formula (14), are: 2-sulfobenzoyl chloride, 3-sulfobenzoyl chloride, 3-sulfobenzoyl chloride, 4-sulfobenzoyl chloride, 3,5-disulfobenzoyl chloride, 3-sulfophthaloyl chloride, 3,4-disulfophthaloyl chloride, 4-sulfophenylacetyl chloride, β-(4-sulfophenyl)propionyl chloride, 3-sulfo-6-methylbenzoyl chloride.

Some of the abovementioned starting materials are known and can be prepared by methods known per se.

The preparation of the compounds of the formula (1) usable according to the invention is described in more detail in U.S. Pat. No. 3,665,031.

Examples of suitable compounds of the formula (1) usable according to the invention are compounds of the formula

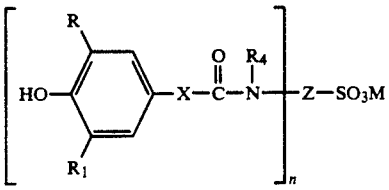

(19)

in which R, $R_1$, $R_4$, X and Z-$SO_3M$ have the following meanings

TABLE 1

| Compound No. | R | $R_1$ | X | $R_4$ | Z—$SO_3M$ | M | m/n | m.p. °C. | $\lambda_{max}$ nm |
|---|---|---|---|---|---|---|---|---|---|
| 1 | $tertC_4H_9$ | $tertC_4H_9$ | $C_2H_4$ | H | 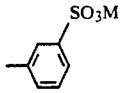 | H | 1/1 | >200 | 242 |
| 2 | $tertC_4H_9$ | $tertC_4H_9$ | $C_2H_4$ | H | 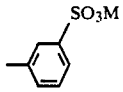 | Na | 1/1 | | 242 |
| 3 | $tertC_4H_9$ | $tertC_4H_9$ | $C_2H_4$ | H | 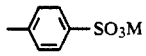 | H | 1/1 | 190 | 254 |
| 4 | $tertC_4H_9$ | $tertC_4H_9$ | $C_2H_4$ | H | 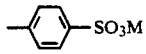 | Na | 1/1 | | 254 |
| 5 | $CH_3$ | $tertC_4H_9$ | $C_2H_4$ | H | 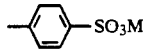 | H | 1/1 | | 254 |
| 6 | $tertC_4H_9$ | $tertC_4H_9$ | $C_2H_4$ | H | 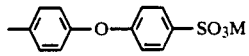 | H | 1/1 | >220 | 250 |
| 7 | $tertC_4H_9$ | $tertC_4H_9$ | $C_2H_4$ | H | 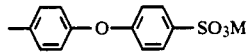 | Na | 1/1 | | |
| 8 | $tertC_4H_9$ | $tertC_4H_9$ | $C_2H_4$ | H | 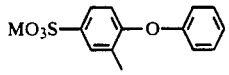 | H | 1/1 | | |
| 9 | $tertC_4H_9$ | $tertC_4H_9$ | $C_2H_4$ | H | 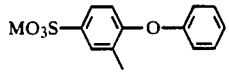 | Na | 1/1 | | |
| 10 | $tertC_4H_9$ | $tertC_4H_9$ | $C_2H_4$ | H | 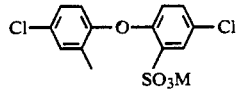 | H | 1/1 | 198 | 282 |
| 11 | $tertC_4H_9$ | $tertC_4H_9$ | $C_2H_4$ | H | 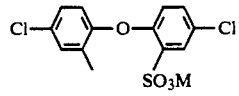 | Na | 1/1 | | |
| 12 | $tertC_4H_9$ | $tertC_4H_9$ | $C_2H_4$ | H | 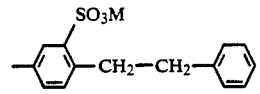 | H | 1/1 | 100 | 251 |
| 13 | $tertC_4H_9$ | $tertC_4H_9$ | $C_2H_4$ | H | 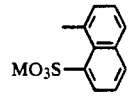 | H | 1/1 | >200 | 298 |
| 14 | $tertC_4H_9$ | $tertC_4H_9$ | $C_2H_4$ | H | 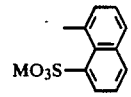 | Na | 1/1 | | |
| 15 | $tertC_4H_9$ | $tertC_4H_9$ | $C_2H_4$ | H | 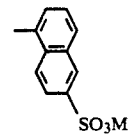 | H | 1/1 | | 280 |

TABLE 1-continued

| Compound No. | R | $R_1$ | X | $R_4$ | Z—$SO_3M$ | M | m/n | m.p. °C. | $\lambda_{max}$ nm |
|---|---|---|---|---|---|---|---|---|---|
| 16 | $tertC_4H_9$ | $tertC_4H_9$ | $C_2H_4$ | H | 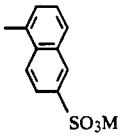 | Na | 1/1 | | |
| 17 | $(tertC_4H_9)_2$ | $(tertC_4H_9)_2$ | $(C_2H_4)_2$ | $(H)_2$ | 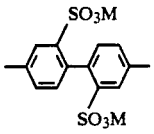 | H | 2/2 | | 260 |
| 18 | $tertC_4H_9$ | $tertC_4H_9$ | $C_2H_4$ | $CH_3$ | —$CH_2$—$CH_2$—$SO_3M$ | H | 1/1 | 224 | 276 |
| 19 | $tertC_4H_9$ | $tertC_4H_9$ | $C_2H_4$ | $CH_3$ | —$CH_2$—$CH_2$—$SO_3M$ | Na | 1/1 | | |
| 20 | $tertC_4H_9$ | $tertC_4H_9$ | $C_2H_4$ | H | 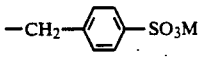 | H | 1/1 | | 273 |
| 21 | $tertC_4H_9$ | $tertC_4H_9$ | — | H | 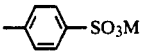 | H | 1/1 | | 280 |
| 22 | $tertC_4H_9$ | $tertC_4H_9$ | NH | H | 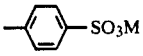 | Na | 1/1 | | |
| 23 | $tertC_4H_9$ | $tertC_4H_9$ | $CH_2$ | H | 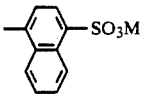 | H | 1/1 | >210–220 | |
| 24 | $tertC_4H_9$ | $tertC_4H_9$ | $CH_2$ | H | 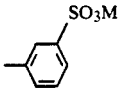 | H | 1/1 | >250 | |
| 25 | $tertC_4H_9$ | $tertC_4H_9$ | $C_2H_4$ | H | 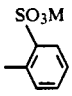 | H | 1/1 | >180 | |
| 26 | $tertC_4H_9$ | $tertC_4H_9$ | $C_2H_4$ | H | 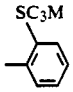 | 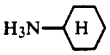 | 1/1 | 210 | |
| 27 | $tertC_4H_9$ | $tertC_4H_9$ | NH | H | 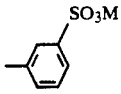 | H | 1/1 | | |
| 28 | $tertC_4H_9$ | $tertC_4H_9$ | NH | H | 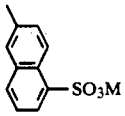 | 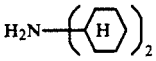 | 1/1 | | |
| 29 | $tertC_4H_9$ | $tertC_4H_9$ | $C_2H_4$ | H | —$CH_2$—$CH_2$—$SO_3M$ | H | 1/1 | 240 | |
| 30 | $(tertC_4H_9)_2$ | $(tertC_4H_9)_2$ | $(C_2H_4)_2$ | $(H)_2$ | 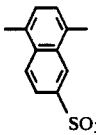 | H | 1/2 | 192 | |
| 31 | $tertC_4H_9$ | $tertC_4H_9$ | $C_2H_4$ | H | 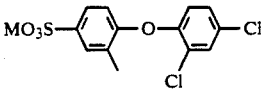 | H | 1/1 | 142 | |

TABLE 1-continued

| Compound No. | R | $R_1$ | X | $R_4$ | Z—$SO_3M$ | M | m/n | m.p. °C. | $\lambda_{max}$ nm |
|---|---|---|---|---|---|---|---|---|---|
| 32 | $tertC_4H_9$ | $tertC_4H_9$ | $C_2H_4$ | H | 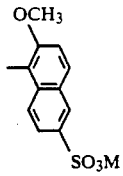 | H | 1/1 | 185 | |
| 33 | $tertC_4H_9$ | $tertC_4H_9$ | $C_2H_4$ | H | 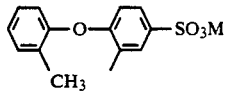 | H | 1/1 | | |
| 34 | $tertC_4H_9$ | $tertC_4H_9$ | $C_2H_4$ | H | 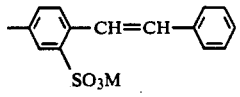 | H | 1/1 | >300 | |
| 35 | $tertC_4H_9$ | $tertC_4H_9$ | NH | $CH_3$ | $-CH_2-CH_2-SO_3M$ | H | 1/1 | | |
| 36 | $tertC_4H_9$ | $tertC_4H_9$ | NH | H | $-CH_2-CH_2-SO_3M$ | 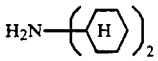 | 1/1 | 153–155 | |
| 37 | $tertC_4H_9$ | $tertC_4H_9$ | $C_2H_4$ | H | 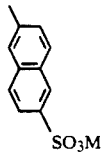 | H | 1/1 | >250 | |
| 38 | $tertC_4H_9$ | $tertC_4H_9$ | $C_2H_4$ | H | 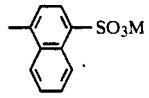 | H | 1/1 | 208 | |
| 39 | $tertC_4H_9$ | $tertC_4H_9$ | $CH_2$ | H | 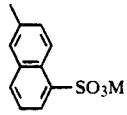 | H | 1/1 | >210 | |
| 40 | $tertC_4H_9$ | $tertC_4H_9$ | $C_2H_4$ | H | 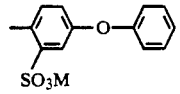 | H | 1/1 | >200 | |
| 41 | $tertC_4H_9$ | $tertC_4H_9$ | $C_2H_4$ | $C_2H_5$ | 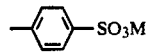 | H | 1/1 | 180 | |
| 42 | $tertC_4H_9$ | $tertC_4H_9$ | $C_2H_4$ | H | 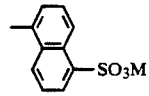 | H | 1/1 | 204 | |
| 43 | $isoC_3H_7$ | $isoC_3H_7$ | $C_2H_4$ | H | 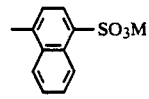 | H | 1/1 | 210 | |
| 44 | $tertC_4H_9$ | $tertC_4H_9$ | — | H | 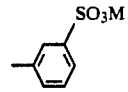 | Na | 1/1 | | |

and the compounds of the formulae (45)

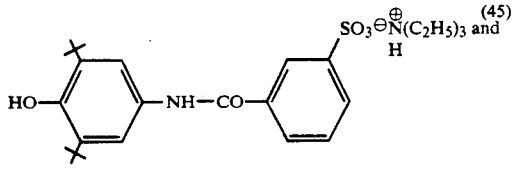

$\lambda_{max}$ 284 nm (46)

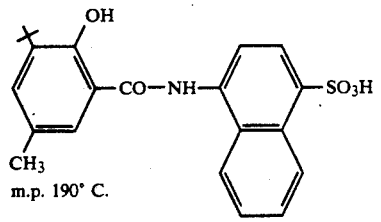

m.p. 190° C.

The compounds of the formulae (8) and (9) can be prepared by processes known per se, such as described in U. S. Pat. Nos. 3,403,183 and 4,127,586.

The compounds of the formula (10) can be prepared in a manner known per se, for example by the processes described in U.S. Pat. Nos. 3,259,627, 3,293,247, 3,423,360 and 4,689,064.

The compounds of the formula (11) can be prepared by processes known per se, such as described in U.S. Pat. No. 3,444,164 or EP-A 165 608.

The compositions used in the process according to the invention contain components (A) and (B) in an amount of 0.01 to 10, preferably 0.2 to 2% by weight in a weight ratio of (A):(B) of 95:5 to 5:95, preferably 60:40 to 40:60, always calculated relative to the material to be dyed.

Application can take place before, during or after dyeing by the exhaust method or a continuous process. Application during dyeing is preferred.

In the exhaust method, the liquor ratio can be selected within a wide range, for example 3:1 to 200:1, preferably 10:1 to 40:1. Advantageously, the process is carried out at a temperature of 20° to 120° C., preferably 40° to 100° C.

In the continuous process, the amount of liquor applied is advantageously 40–700, preferably 40–500%, by weight. The fibre material is then subjected to a heat treatment in order to fix the dyes and antioxidants applied. This fixing can also be carried out by the cold pad-batch method.

The heat treatment is preferably carried out by a steaming process with treatment in a steamer using steam, which may be superheated, at a temperature of 98° to 105° C. for a period of, for example, 1–7, preferably 1–5, minutes. Fixing of the dyes by the cold pad-batch method can be carried out by storing the impregnated and preferably uprolled material at room temperature (15° to 30° C.), for example for 3 to 24 hours, the cold pad-batch time being dependent, as is known, on the dye.

After the dyeing process and the fixing are complete, the dyeings produced are washed in the usual manner and dried.

Undyed and dyed fibre materials having good thermal and/or photochemical stability are obtained by the method of the present invention.

Dyeings to be stabilised according to the invention are those which are produced by disperse, acid or metal complex dyes, in particular azo, 1:2 metal complex dyes, for example 1:2 chromium, 1:2 cobalt complex dyes or copper complex dyes.

Examples of these dyes are described in Colour Index, 3rd edition, 1971, volume 4.

Polyamide materials are understood to mean synthetic polyamide, for example nylon-6, nylon-6,6 or nylon-12, and modified polyamide, for example polyamide which can be coloured under basic conditions. Apart from the pure polyamide fibres, in particular fibre blends made of polyurethane and polyamide are also suitable, for example knitted material made of polyamide/polyurethane in a blend ratio of 70:30. In general, the pure polyamide material or the blend can be present in a wide range of processing forms, for example as fibre, yarn, woven, knitted, nonwoven or pile fabric.

In particular dyeings on polyamide material which is exposed to light and/or heat and present, for example, as carpets or automobile upholstery fabric are particularly suitable for being treated by the present process.

The examples which follow illustrate the invention. Parts and percentages are by weight.

EXAMPLE 1

Three 10 g samples of nylon-6 knitwear are dyed, for example, in a ®Zeltex Vistracolor dyeing apparatus at a liquor ratio of 30:1. For this purpose, 3 liquors are prepared containing 0.5 g/l of monosodium phosphate and 1.5 g/l of disodium phosphate (=pH 7) and 0.2% of the dye of the formula (100)

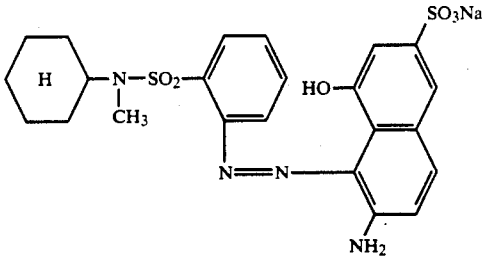

(Red)

in dissolved form. Liquor (1) does not receive any further addition, whereas liquor (2) receives 1% of the compound of the formula (101)

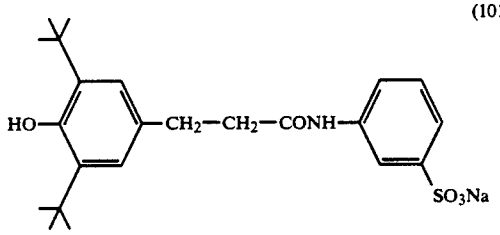

and liquor (3) 1% of the compound (101) and additionally 1% of the compound of the formula (102), always relative to the material to be dyed.

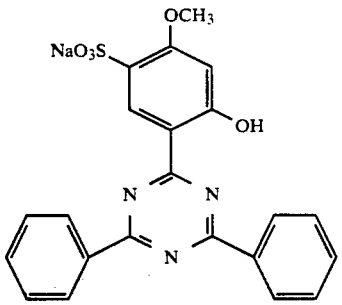

(102)

Dyeing is started at 40° C., maintaining this temperature for 10 minutes, and the liquor is then heated to 95° C. within 30 minutes. After a dyeing time of 20 minutes at 95° C., 2% of acetic acid (80%) is added to each liquor and dyeing is continued for another 30 minutes. The liquor is then cooled to 70° C., and the samples are rinsed, centrifuged and dried at 80° C.

The dyeings are tested for light fastness according to SN-ISO 105-B02 (Xenon) and DIN 75202 (Fakra). To test the photochemical stability of the fibre material, samples are exposed according to DIN 75202 for 216 hours and tested for tear strength and elongation according to SN 198.461.

| | Results: | | |
|---|---|---|---|
| | Light fastness | | *Tear strength/elongation |
| Dyeing | XENON | FAKRA 72 h | after 216 h FAKRA |
| 1 | 6–7 | 1–2 | 13.4/38.4% |
| 2 | 6–7 | 3–4 | 65.6/63.3% |
| 3 | 7 | 3–4 | 74.8/83.8% |

*unexposed dyeings as standard

These results show that compounds (101) and (102) give the dyeings not only photochemical but also thermal protection.

EXAMPLE 2

3 dyeings (4), (5) and (6) are produced as described in Example 1, except that the following 1:2 metal complex dye of the formula (200)

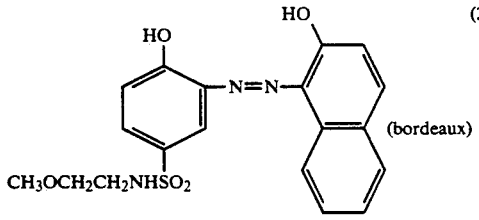

(200)

1:2 cobalt complex is used.

Testing gave the following result:

| | Light fastness | | *Tear strength/elongation |
|---|---|---|---|
| Dyeing | XENON | FAKRA 72 h | after 216 h FAKRA |
| 4 | 7 | 2 | 15.8/39.6% |
| 5 | 7 | 3–4 | 56.8/72.8% |
| 6 | 7 | 4 | 75.7/83.8% |

*unexposed dyeings as standard

It can be seen that the use of compounds (101) and (102) lead to an improvement in photochemical stability.

EXAMPLE 3

Two 10 g samples of a nylon knitted fabric are dyed, for example in a ®Zeltex Vistracolor dyeing apparatus at a liquor ratio of 30:1. For this purpose, 2 dyeing liquors containing 0.5 g/l of monosodium phosphate and 1.5 g/l of disodium phosphate (=pH 7) and 0.04% of the dye comprising

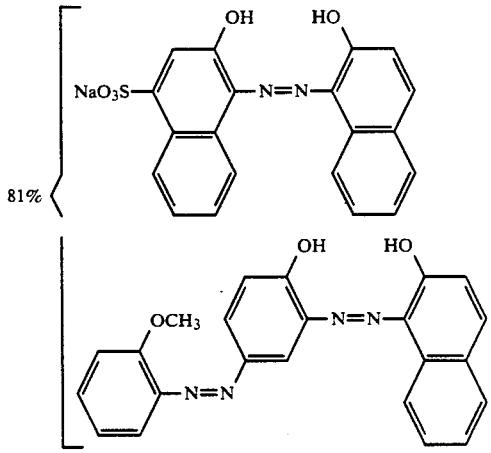

1:2 chromium complex

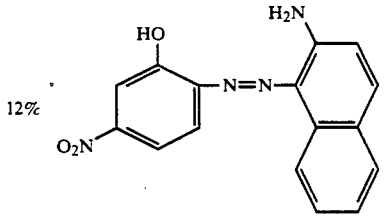

1:2 cobalt complex and

7% of surface-active substances, 0.002% of the dye of the formula (200) and 1% of the compound

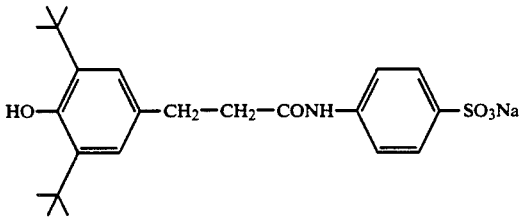

(300)

are used.

Dyeing liquor 2 additionally contains 1% of the compound of the formula

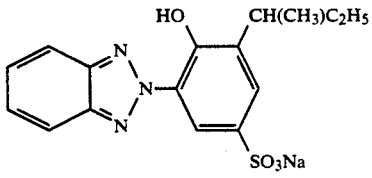

(301)

Dyeing and testing is carried out as described in Example 1. The results can be seen from the table below.

| Dyeing | Light fastness XENON | Light fastness FAKRA 72 h | *Tear strength/elongation after 216 h FAKRA |
|---|---|---|---|
| 1 | 7-8 | 3+ | 56.3/70.5% |
| 2 | 7-8 | 4 | 70.9/82.7% |

*untreated samples are standard

EXAMPLE 4

Three 20 g samples of a nylon-66 automobile carpet (about 850 g/m$^2$; total pile thickness=5.5/7 mm) are dyed in a pot-type dyeing apparatus, for example a Labomat® (from Mathis) at a liquor ratio of 20:1 (as described in Example 3).

Liquor 1 does not contain any further additive, liquor 2 contains 1% of the compound of the formula (400)

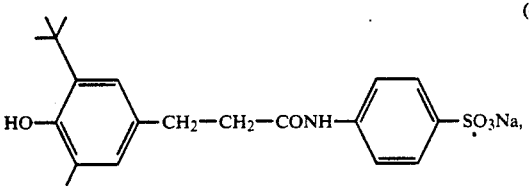

while 1% of compound (400) and 0.75% of compound (102) are added to liquor 3. All compounds are calculated relative to the weight of the carpet sample and added to the dyeing liquor in dissolved form.

The dyeing process is carried out as described in Example 1.

The finished dyeings are, on the one hand, exposed in order to determine their light fastness according to DIN 75.202 (=Fakra) and, on the other hand, exposed as samples of 4.5×12 cm for 360 hours according to DIN 75.202 for the Martindale abrasion test (SN 198.529).

The results obtained are summarized in the table below:

| Dyeing | LIGHT FASTNESS FAKRA 144 h | LIGHT FASTNESS FAKRA 288 h | MARTINDALE ABRASION TEST Weight loss | MARTINDALE ABRASION TEST Thickness loss |
|---|---|---|---|---|
| 1. | 1 | 1 | 24% | 45% |
| 2. | 2-3 | 1-2 | 8.4% | 24% |
| 3. | 3 | 2-3 | 5.3% | 17% |

The results show that the carpet dyeing using compound (400) is significantly stabilised, although it can be improved once again by combination with the UV absorber.

EXAMPLE 5

Three 10 g samples of a nylon-66/Lycra® knitted fabric (80.20) are dyed with 0.2% of dye (100) as described in Example 1. Liquor 1 does not receive any further additives. 1% of compound (300) is added to liquor 2 in dissolved form and 1% of compound (300) and 0.75% of compound (102) are added to liquor 3.

The light fastness and photochemical stability of the dyeings is also determined as described in Example 1. The following results were obtained:

| DYEING | LIGHT FASTNESS FAKRA 72 h | TEAR STRENGTH/ELONGATION after exposure for 144 h according to Fakra |
|---|---|---|
| 1. | 1-2 | 5.6/29.2% |
| 2. | 2 | 46.0/59.4% |
| 3. | 3 | 60.9/75.8% |

These results show that the use of compounds (300) causes an improvement in photochemical stability, which is improved once again by combination with compound (102).

EXAMPLES 6-10

6 10 g samples of a nylon-6 knitted fabric are dyed according to Example 3 and dyed and finished by the process described in Example 1, except that the following UV absorbers are added, and then tested for light fastness according to SN-ISO 105-B02 (Xenon) and DIN 75.202 (Fakra).

The following compounds are used in the amounts shown in the table:

(600)

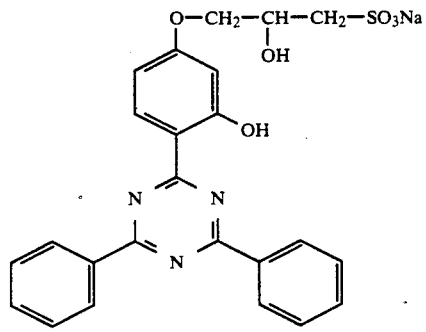

(601)

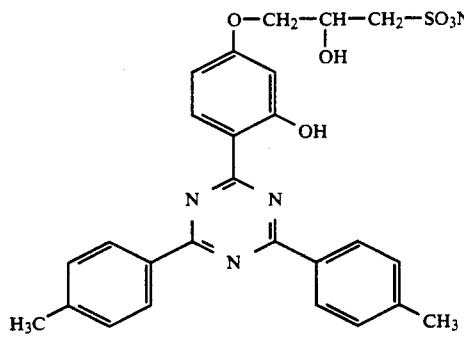

(602)

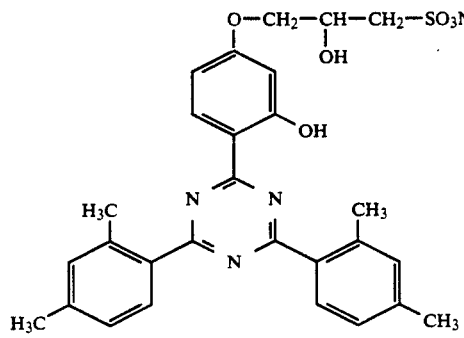

-continued (603)

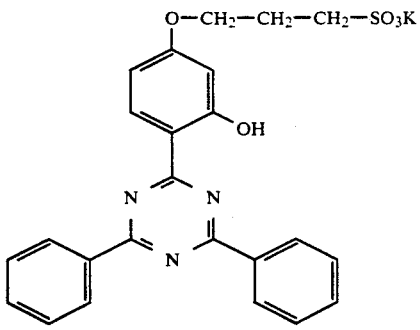

(604)

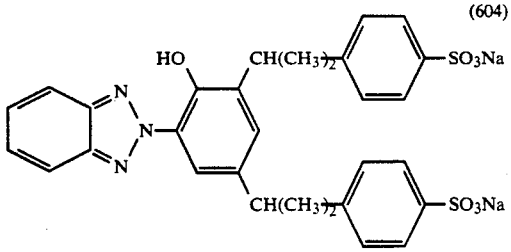

The results of the light fastness evaluations can be seen from the table below.

| Sample No. | Addition to the dyeing | LIGHT FASTNESS Xenon | Fakra 144 h | Fakra 216 h |
|---|---|---|---|---|
| 0 | no addition | 6-7 | 1H | 1H |
| 1 | +1% of compound (300) | 6-7 | 3-4 | 2-3 |
| 2 | +1% of compound (300) +0.75% of compound (600) | 7 | 4-5 | 4 |
| 3 | +1% of compound (300) +0.75% of compound (601) | 7 | 4 | 3-4 |
| 4 | +1% of compound (300) +0.75% of compound (602) | 7 | 4-5 | 4 |
| 5 | +1% of compound (300) +0.75% of compound (603) | 7 | 4-5 | 4 |
| 6 | +1% of compound (300) +0.75% of compound (604) | 7 | 4 | 3 |

It can be seen that the additional use of the compounds of the formulae (600) to (604) leads to an improvement in hot light fastness properties.

EXAMPLES 11-15

Twelve 10 g samples of a nylon-6 knitted fabric are dyed and tested as described in Examples 6-10, except that the compounds listed in the table are used in the amounts mentioned.

(605)

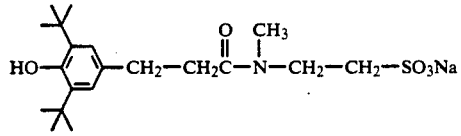

(606)

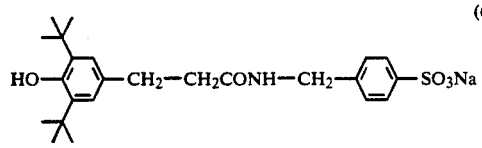

-continued (607)

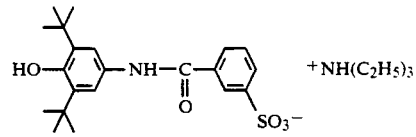

(608)

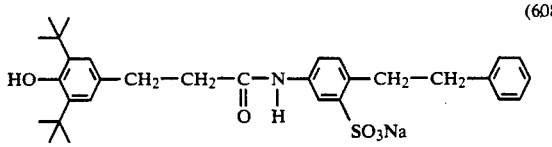

| Dyeing No. | Addition to the dyeing | LIGHT FASTNESS Xenon | Fakra 144 h | Fakra 216 h |
|---|---|---|---|---|
| 1 | no addition | 6-7 | 1H | 1H |
| 2 | +0.75% of compound (600) | 7 | 2 | 1-2 |
| 3 | +1.00% of compound (400) | 7 | 2-3 | 2 |
| 4 | +1.00% +0.75% of compound (400) + (600) | 7 | 4 | 3 |
| 5 | +1.00% of compound (605) | 7 | 2-3 | 1-2 |
| 6 | +1.00% +0.75% of compound (605) + (600) | 7 | 3-4 | 2-3 |
| 7 | +1.00% of compound (606) | 7 | 3-4 | 3 |
| 8 | +1.00% +0.75% of compound (606) + (600) | 7 | 4 | 3-4 |
| 9 | +1.00% of compound (607) | 7 | 4 | 3-4 |
| 10 | +1.00% +0.75% of compound (607) + (600) | 7 | 4-5 | 4 |
| 11 | +1.00% of compound (608) | 7 | 3-4 | 2-3 |
| 12 | +1.00% +0.75% of compound (608) + (600) | 7 | 4-5 | 4 |

These results show that the combination of phenolic antioxidants with UV absorbers, for example those of the formula (600), always leads to an improvement in hot light fastness properties.

We claim:

1. A process for improving the thermal and/or photochemical stability of dyed polyamide fibres, which comprises treating the fibres with an agent from an aqueous bath containing (A) a water-soluble compound of the formula $$(A—Y—)_nZ(—W)_m \quad (1)$$

in which A is the radical of a sterically hindered phenol from the benzene series, Y is a radical of the formulae (2) or (3)

(2)

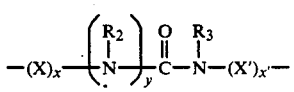

(3)

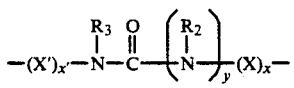

in which X and X', independently of one another, are alkylene, oxaalkylene or thiaalkylene, $R_2$ and $R_3$, independently of one another, are hydrogen or a substituted or unsubstituted alkyl group and x,x' and y, independently of one another, are each 0, or 1, Z is an aliphatic or a carbocyclic aromatic radical, the latter containing at most two mono- or bicyclic rings, W is a sulfo group and m and n, independently of one another, are 1 or 2, and their water-soluble salts, and (B) a UV absorber, wherein the compound of formula (1) and the UV absorber goes onto the fibers by an exhaust or continuous dyeing process.

2. A process according to claim 1, wherein component (A) used is a compound of the formula (1) in which A is a monohydroxyphenyl radical in which at least one o portion with respect to the hydroxyl group is substituted by alkyl having 1–12 C atoms, cycloalkyl having 6–10 C atoms or aralkyl having 7–10 C atoms and which, if desired, carries further substituents.

3. A process according to claim 1, wherein component (A) used is a compound of the formula (1) in which A is a radical of the formula (4)

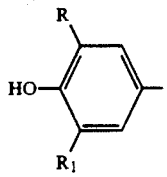

(4)

in which R and $R_1$, independently of one another, are hydrogen, methyl or tert-butyl and the sum of the carbon atoms of R and $R_1$ is at least 2.

4. A process according to claim 1, wherein X and X' in the compounds of the formulae (2) and (3) are straight-chain or branched alkylene having 1–8 C atoms.

5. A process according to claim 1, wherein $R_2$ and $R_3$ in the compounds of the formulae (2) and (3) are straight-chain or branched $C_1$–$C_8$alkyl.

6. A process according to claim 1, wherein $R_2$ and $R_3$ in the compounds of the formulae (2) and (3) are hydroxyalkyl, alkoxyalkyl, aminoalkyl, alkylaminoalkyl or dialkylaminoalkyl each having a total of 2–10 C atoms or are phenyl.

7. A process according to claim 1, wherein Y in formula (1) is a radical of the formula (5)

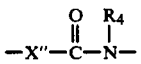

(5)

in which $R_4$ is hydrogen or $C_1$–$C_4$alkyl and X'' is $C_1$–$C_4$alkylene.

8. A process according to claim 7, wherein Z in formula (1) is the radical of an unsubstituted or carboxy-substituted alkane having at least 2 C atoms, the radical of a benzene ring which is unsubstituted or substituted by chlorine or bromine, $C_1$–$C_4$alkyl, $C_1$–$C_4$alkoxy, $C_1$–$C_4$alkoxycarbonylamino, hydroxyl, carboxy, phenylethyl, styryl, phenyl, phenoxy, phenylthio, phenylsulfonyl or acylamino, in which the group W can be bound directly to this benzene ring or to a monocyclic aryl radical of one of its substituents, or it is a naphthalene or tetraline radical.

9. A process according to claim 1, wherein component (A) used is a compound of the formula (7)

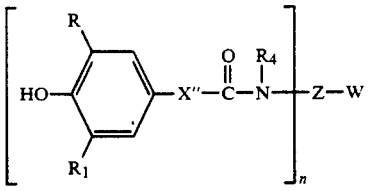

(7)

in which R and $R_1$, independently of one another, are methyl, or tert-butyl, $R_4$ is hydrogen or $C_1$–$C_4$alkyl, X'' is $C_1$–$C_4$alkylene, Z is an ethylene radical, a di- or trivalent radical of benzene or naphthalene or a divalent radical of diphenyl ether, W is a sulfo group and n is 1 or 2.

10. Process according to claim 9, wherein component (A) used is a compound of the formula (7) in which R and $R_1$ are tert-butyl, X'' is methylene or ethylene, $R_4$ is hydrogen, methyl or ethyl and Z is ethylene, o-, m- or p-phenylene, 1,4-naphthylene, 1,8-naphthylene, 2-methoxy-1,6-naphthylene, 1,5-naphthylene, 2,5-naphthylene, 2,6-naphthylene, 1,4,6-naphthalenetriyl or the radicals

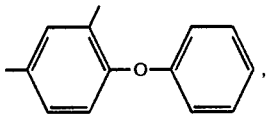

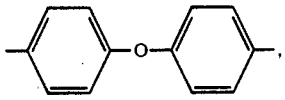

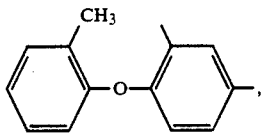

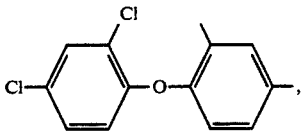

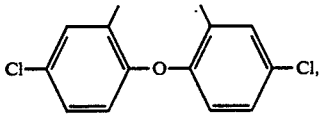

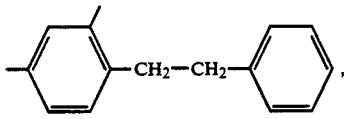

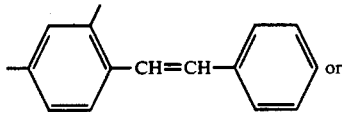

-continued

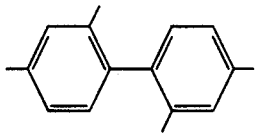

in which the sulfo group W is present in the form of its alkali metal salts or ammonium salts.

11. A process according to claim 1, wherein component (B) used is a 2-hydroxybenzophenone of the formula

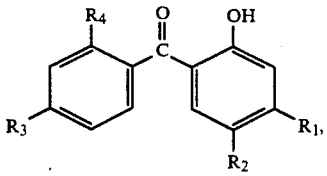

(8)

in which $R_1$ is hydrogen, hydroxyl, $C_1$–$C_{14}$alkoxy or phenoxy, $R_2$ is hydrogen, halogen, $C_1$–$C_4$alkyl or sulfo, $R_3$ is hydrogen, hydroxyl or $C_1$–$C_4$alkoxy and $R_4$ is hydrogen, hydroxyl or carboxy.

12. A process according to claim 1, wherein component (B) used is a 2-(2'-hydroxyphenyl)benzotriazole of the formula

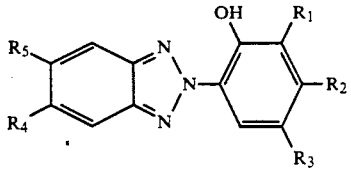

(9)

in which $R_1$ is hydrogen, chlorine, sulfo, $C_1$–$C_{12}$alkyl, $C_5$–$C_6$cycloalkyl, ($C_1$–$C_8$alkyl)phenyl, $C_7$–$C_9$phenylalkyl or sulfonated $C_7$–$C_9$phenylalkyl, $R_2$ is hydrogen, chlorine, $C_1$–$C_4$alkyl, $C_1$–$C_4$alkoxy, hydroxyl or sulfo, $R_3$ is $C_1$–$C_{12}$alkyl, chlorine, sulfo, $C_1$–$C_4$alkoxy, phenyl, ($C_1$–$C_8$alkyl)phenyl, $C_5$–$C_6$cycloalkyl, $C_2$–$C_9$alkoxycarbonyl, carboxyethyl, $C_7$–$C_9$phenylalkyl or sulfonated $C_7$–$C_9$phenylalkyl, $R_4$ is hydrogen, chlorine, $C_1$–$C_4$alkyl, $C_1$–$C_4$alkoxy, $C_2$–$C_9$alkoxycarbonyl, carboxy or sulfo and $R_5$ is hydrogen or chlorine.

13. A process according to claim 1, wherein component (B) used is a 2-(2'-hydroxyphenyl)-s-triazine of the formula

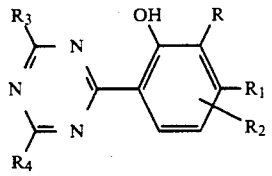

(10)

in which R is hydrogen, halogen, $C_1$–$C_4$alkyl or sulfo, $R_1$ is hydrogen, $C_1$–$C_4$alkyl, $C_1$–$C_4$alkoxy or hydroxyl, $R_2$ is hydrogen or sulfo and $R_3$ and $R_4$, independently of one another, are $C_1$–$C_4$alkyl, $C_1$–$C_4$alkoxy, $C_5$–$C_6$cycloalkyl, phenyl or phenyl substituted by $C_1$–$C_4$alkyl and/or hydroxyl.

14. A process according to claim 1, wherein component (B) used is an s-triazine compound of the formula

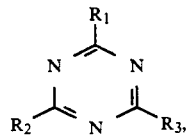

(11)

in which at least one of the substituents $R_1$, $R_2$ and $R_3$ is a radical of the formula

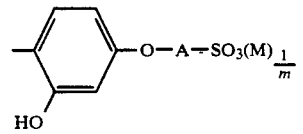

(12)

in which A is $C_3$–$C_4$alkylene or 2-hydroxytrimethylene and M is sodium, potassium, calcium, magnesium, ammonium or tetra-$C_1$–$C_4$alkylammonium and m is 1 or 2, and the remaining substituent or the remaining substituents are, independently of one another, $C_1$–$C_{12}$alkyl, phenyl, $C_1$–$C_{12}$alkyl which is bound to the triazinyl radical via oxygen, sulfur, imino or $C_1$–$C_{11}$alkylimino, or are phenyl or a radical of the formula (12).

15. A process according to claim 1 for improving the thermal and/or photochemical stability of polyamide fibres dyed with disperse, acid or metal complex dyes.

16. A dyed polyamide fibre treated by the process according to claim 1.

* * * * *